US005988561A

United States Patent [19]

Mele

[11] Patent Number: 5,988,561

[45] Date of Patent: Nov. 23, 1999

[54] ROLLED PRODUCT DISPENSER WITH BRAKING MECHANISM

[76] Inventor: Peter C. Mele, P.O. Box 533, Crown Point, N.Y. 12928

[21] Appl. No.: 08/383,819

[22] Filed: Feb. 6, 1995

[51] Int. Cl.[6] ..... B65H 16/06; B65H 18/04

[52] U.S. Cl. ..... 242/599.1; 242/599.2; 242/599.3; 242/599.4

[58] Field of Search ..... 242/599, 599.1, 242/599.3, 599.4, 611, 396.1, 396.4, 383.2, 596.7, 597.5

[56] References Cited

U.S. PATENT DOCUMENTS

| | | | |
|---|---|---|---|
| 1,500,938 | 7/1924 | Howard | 242/383.2 X |
| 2,990,131 | 6/1961 | Carlsson | 242/383.2 X |
| 3,002,704 | 10/1961 | Grossfeld | 242/599.1 |
| 4,191,342 | 3/1980 | Reinhold | 242/599.1 X |
| 4,212,434 | 7/1980 | Walker | 242/599.1 |
| 4,285,474 | 8/1981 | Perez | 242/55.2 |
| 4,314,678 | 2/1982 | Upchurch | 242/599.1 |
| 4,383,656 | 5/1983 | Campbell | 242/599.3 X |
| 4,454,974 | 6/1984 | Cooke | 225/106 |
| 4,466,563 | 8/1984 | Zuss | 225/74 |
| 4,738,385 | 4/1988 | Bell | 225/106 |
| 4,771,966 | 9/1988 | Anderson | 242/55.2 |
| 4,792,102 | 12/1988 | Olsen | 242/55.54 |
| 5,135,179 | 8/1992 | Morano | 242/55.54 |
| 5,170,956 | 12/1992 | McTaggart | 242/55.2 |
| 5,273,227 | 12/1993 | Smith, Jr. | 242/55.2 |

*Primary Examiner*—John Q. Nguyen
*Attorney, Agent, or Firm*—George E. Kersey

[57] ABSTRACT

A rolled product dispenser with an automatic brake and release, in which a compression spring maintains mounting shaft pressure to hold the product dispenser in a housing, with holding caps wedged into the ends of the roll that rotates coaxially with respect to a peg disc having a stop peg positioned in relation to adjustable grounding pegs by which prescribed contact is maintained with the housing, the stop peg being engaged by a centrifugal flag that rotates with the roll as product is being unwound until a sufficient rotational speed caused the flag to hit the stop peg and stop roll rotation, serving as an automatic brake, following which tearing of the product produces a recoil that releases the flag, the speed at which the centrifugal flag impacts the stop peg being adjustable by changing the position of the stop peg in relation to the mounting shaft axis of rotation.

20 Claims, 2 Drawing Sheets

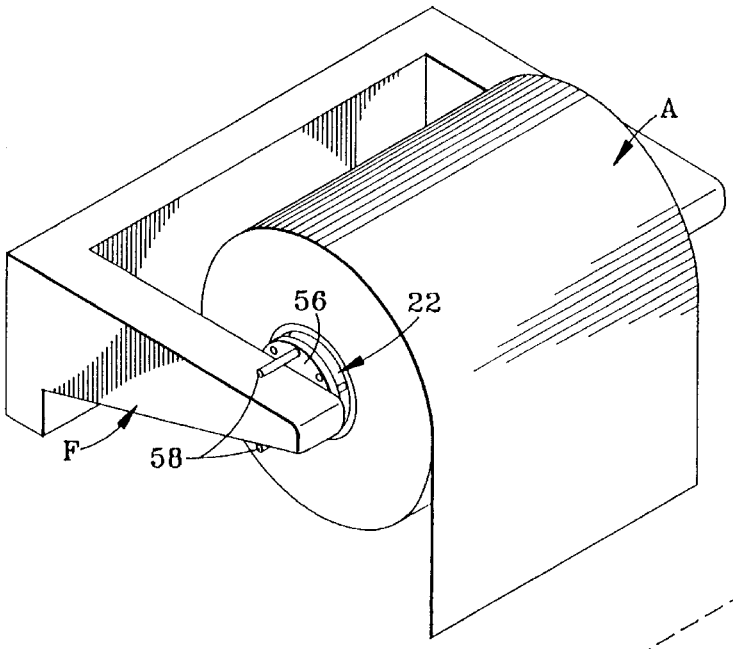
FIG. 1
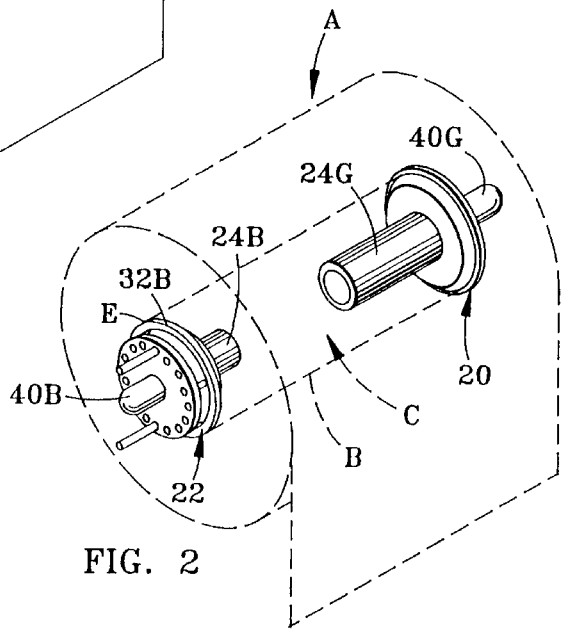
FIG. 2
FIG. 3
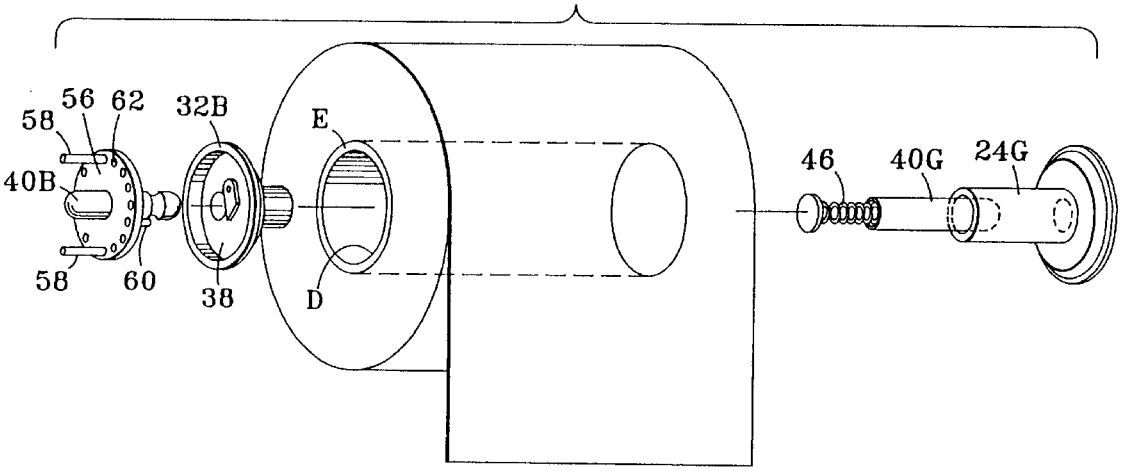

FIG. 4
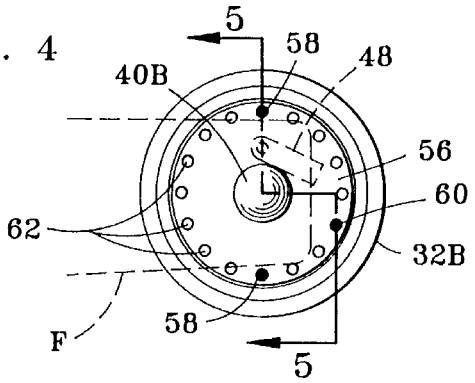
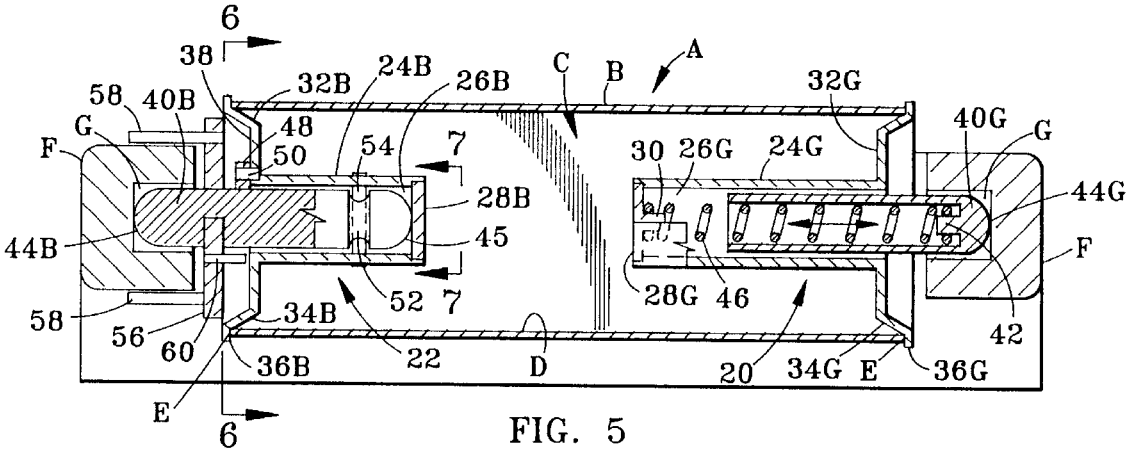
FIG. 5
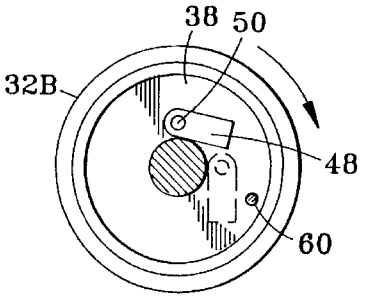
FIG. 6
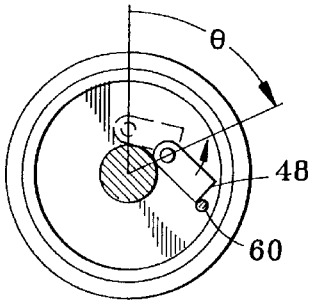
FIG. 6A
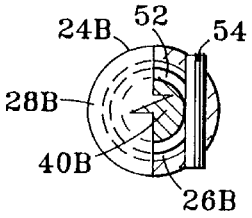
FIG. 7
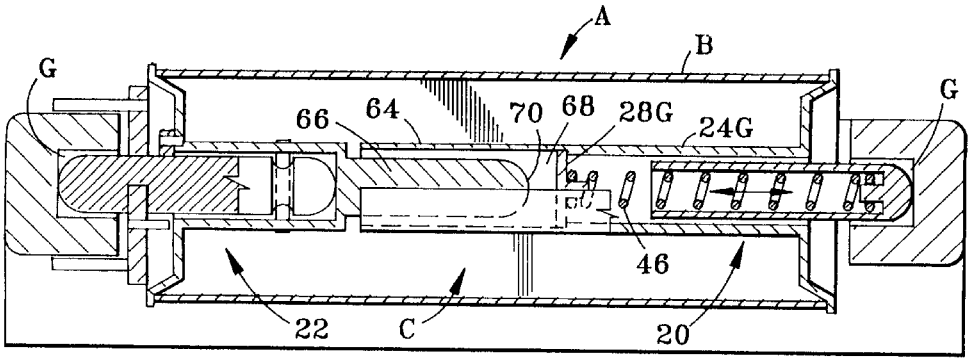
FIG. 8

ROLLED PRODUCT DISPENSER WITH BRAKING MECHANISM

BACKGROUND OF THE INVENTION

1. Field of Invention

This invention relates to dispensers for rolled products, and more particularly, to a braking mechanism for dispensers of rolled products.

2. Related U.S. Application Data

This invention received a design patent, DES. U.S. Pat. No. 343,973 on Feb. 8, 1994.

3. Description of the Prior Art

Various household products, such as toilet paper or paper towels, are supplied in a continuous roll wherein the desired amount of product can be removed for its intended use. The product is coaxially wound around a hollow, cylindrical tube. A horizontally mounted toilet paper dispenser typically includes a stationary housing with two recesses. A dispenser shaft is inserted into the inner hollow core of the toilet paper tube. The shaft ends are then inserted into the recesses, thus supporting the roll in the dispenser. The most common horizontally mounted paper towel disperser includes a stationary housing with two spaced apart end pieces which clamp into the ends of the hollow paper towel tube. The user pulls the lead sheet until a desired amount is obtained. With a sudden tag, the paper is separated from the roll.

Unfortunately, in many paper towel dispensers there is too much friction imposed on the paper towel tube as the stationary end pieces of the dispenser are clamped into the tube ends. This provides such high resistance to rotation of the paper towel tube that the paper is often ripped off the roll prematurely. Therefore, a free hand is needed to help turn the roll in order to get the desired amount of toweling.

Conversely, in most conventional toilet paper dispensers, the shafts have a smaller diameter than the diameter of the inner core of the toilet paper tube. Therefore, the roll rotates freely and rapidly when paper is being unwound. This leads to wasted paper as the sudden tug to tear off the paper, sends the roll spinning. It also results in further frustration and wasted time as the user attempts to rewind the paper back onto the roll, resulting in an unsightly display. This is especially true for those who have very young children who have discovered the fan of unwinding toilet paper and paper towels from their dispensers.

Therefore, users are most often faced with having to brake the action of the roll themselves. They use one hand to pull on the lead sheet, and the other to stop and hold the roll in order to tear the paper off. This is inconvenient when hands are wet or otherwise occupied. It is also difficult when the dispenser is located in an awkward location such as in back, underneath an upper cabinet in the kitchen or when a toilet paper dispenser is mounted on the wall behind you. Again, many young children seem to have a hard time coordinating their hands to do different actions.

As a result of these problems, numerous attempts have been made to design dispensers to restrain undesired spinning. Several of these efforts are disclosed in the following U.S. patents: U.S. Pat. No. 4,771,966, Anderson, Nov. 2, 1987; U.S. Pat. No. 4,285,474, Perez, Aug. 5, 1981; U.S. Pat. No. 5,273,227. Smith Jr., Dec. 28, 1993; U.S. Pat. No. 4,454,974, Cooke, Jun. 19, 1984, U.S. Pat. No. 4,792,102, Olson, Dec. 18, 1987; and U.S. Pat. No. 4,466,563, Zuss, Aug. 21, 1984. They reduce the spin of the roll through the use of: rotation-retardant material placed on various parts of the product roll or dispenser, by weighted frictional pieces placed on the end of a roll, or by counterbalanced lever bars with friction pads, arcuate brake bars or dependent hinges which tangentially rest upon the roll. Many of these techniques are expensive, require dispensers which fail to use conventional dispenser housings found in most homes, or necessitate serrated cutting edges which are not child-safe. They continue to waste paper since a frictional stop takes time and since many of the techniques tend to incessantly engage the roll so tightly that users unintentionally tear the product from the roll prematurely.

Dispensers with actual braking mechanisms can be seen in U.S. Pat. No. 4,738,385, Bell, Apr. 19, 1988, U.S. Pat. No. 5,135,179, Morano, Apr. 4, 1992 and U.S. Pat. No. 5,170, 956, McTaggart, Dec. 15, 1992. However, they again require a free hand, arm, or elbow to engage the brake while the other hand tears the product from the roll.

SUMMARY OF THE INVENTION

Accordingly, it is the primary object of the present invention to provide a rolled product dispenser that would allow the easy dispensing of a product using only one hand.

It's a further object of the present invention to prevent waste and frustration by providing a rolled product dispenser which dispenses the proper amount of product desired.

Another object of the present invention is to provide a rolled product dispenser with an adjustable braking mechanism which adapts to the user's habits and needs. This includes providing a child-safe dispenser for common rolled products children use each day, which can be adjusted with their changing maturity and habits in mind.

Yet another object of the present invention is to provide a rolled product dispenser which can be adapted to dispense rolled products from tubes of varying sizes.

A final object of the present invention is to provide a rolled product dispenser which further saves money because it can be used with dispenser housings most people already have in their homes.

To achieve the desired objects of this present invention in accordance with tile preferred embodiment thereof, an improved dispenser is provided for supporting a roll of product and for selectively brating rotation of the roll.

The dispenser comprises a gripping assembly and a braking assembly. More specifically a compression spring maintains pressure on both the mounting shafts holding the dispenser and roll in the housing, as well as the tapered holding caps wedged into the ends of the tube to allow coaxial rotation of the roll and the dispenser.

The adjustable braking assembly comprises a grounding means and a braking means. More specifically, a holder allows grounding pegs to be adjusted to contact the dispenser housing in regards to a stop peg's position in relation to the axis of rotation of the mounting shaft. That is, if a user wants the brake to engage at a slower speed and gentler touch, the stop peg is positioned sufficiently below the axis of rotation of the mounting shaft. If a user wants the brake to engage when product is pulled at a higher speed and a more definite tug, the stop peg is positioned higher in relation to the axis of rotation of the mounting shaft. The grounding pegs are accordingly adjusted against the dispenser housing. A centrifugal flag rotates on the holding cap and is positioned to hit the stop peg when rotated at sufficient speed. Once hit, the stop peg brakes the rotation of the centrifugal flag and the roll and ensures no further movement since it's located in the holder grounded by the grounding pegs against the dispenser housing.

These features enable the user to automatically engage the brake when the selected amount of product is being torn from the roll with one hand. It further enables the user to adjust the brake to engage at a more appropriate speed to accommodate individual use and family needs.

The present invention may also include an extended support and holding structure to more easily align the dispenser assemblies within the roll.

The structure and method of operation of the present invention, together with further objects and advantages thereof, will be better understood when consideration is given to the following detailed description in connection with the accompanying drawings.

BRIEF DESCRIPTION OF THE DRAWINGS

FIG. 1 is a perspective view of the invention mounted in a paper roll and housing assembly.

FIG. 2 is a perspective view of the invention.

FIG. 3 is an exploded view of the invention.

FIG. 4 is an end elevation view of the braking assembly.

FIG. 5 is a vertical view, partly in cross-section and partly broken away, taken on line 5—5 of FIG. 4.

FIG. 6 is an end elevation taken on line 6—6 of FIG. 5, which in phantom illustrates the position of the centrifugal flag with the brake released.

FIG. 6A is a similar view as FIG. 6, but illustrates the position of the centrifuqal flag with the brake engaged.

FIG. 7 is a view of the retaining pin in partial section taken on line 7—7 of FIG. 5.

FIG. 8 is an alternative embodiment.

DETAILED DESCRIPTION OF THE PREFERRED EMBODIMENTS

The dispenser as shown in FIGS. 1, 5, and 8 is used to dispense rolled products such as paper towels or toilet paper. FIG. 1 shows a perspective view of a roll of toilet paper A rotatably supported within a conventional, horizontal dispenser housing F. Dispenser housing F is commonly attached to a wall or cabinet. In FIG. 2. spindles 24G and 24B are inserted into inner core C of the toilet paper tube B. Conventional housings normally have recesses G, (only visible in FIGS. 5 and 8), to receive mounting shafts 40G and 40B which project from spindles 24G and 24B, thereby holding toilet paper roll A rotatably in place for dispensing.

As shown more clearly in FIG. 2, there are two related assemblies which are inserted into the inner core C of toilet paper tube B, gripping assembly 20 and braking assembly 22. FIG. 3 shows the individual parts of both assemblies in exploded form.

Turn to FIG. 5 which most clearly illustrates each part's position, interconnections, and function. Gripping assembly 20 has cylindrical, hollow spindle 24G with a holding cap 32G on one end. Holding cap 32G has a tapered outer area 34G and a shoulder 36G. Mounting shaft 40G is a cylindrical tube with a smaller diameter than spindle 24G and slides into hollow cavity 26G of spindle 24G. Compression spring 46 is contained which are mounting shaft 40G and spindle 24G. The ends of compression spring 46 are positioned over posts 42 and 30 which are located in the inner tip of mounting shaft 40G and base plug 28G of spindle 24G respectively. Exterior tip 44G of mounting shaft 40G projects into recess G of dispenser housing F.

Braking assembly 22 has hollow, cylindrical spindle 24B with a holding cap 32B which has a tapered area 34B and shoulder 36B. A centrifugal flag 48, (also seen in FIG. 6), is attached to the flat exterior surface 38 of holding cap 32B by pin 50, which holds one end of centrifugal flag 48 rotatably in place.

(FIG. 5) Mounting shaft 40B slides into hollow cavity 26B of spindle 24B. Mounting shaft 40B has a groove 52 around it's circumference which corresponds to a retaining pin 54 inserted through spindle 24B, (FIG. 7 shows this in cross-section along line 7—7). This keeps mounting shaft 40B from separating from spindle 24B, yet allows spindle 24B to rotate freely around mounting shaft 40B. Interior tip 45 of mounting shaft 40B is rounded and touches base plug 28B of spindle 24B. External tip 44B of mounting shaft 40B is inserted into recess G of dispenser housing F.

Peg disc 56 is attached onto the exposed part of mounting shaft 40B between dispenser housing F and the flat exterior surface 38 of holding cap 32B. Peg disc 56 has a series of holes 62 around its outer edge, (also seen in FIG. 4). Grounding pegs 58 extend from selected holes in peg disc 56 and contact dispenser housing F (this is best seen in FIG. 1). Stop peg 60 is located in a hole in peg disc 56 and extends towards, but does not contact the flat exterior surface 38 of holding cap 32B.

FIG. 8) shows modification of the preferred embodiment seen in FIG. 5. Gripping assembly 20 is modified to include an extended alignment spindle 64 which is additional length added to spindle 24G in the preferred embodiment (FIG. 5). Extended alignment spindle 64 extends from spindle base plug 28G and is hollow. It mates with alignment shaft 66 which is added onto the preferred embodiment (FIG. 5) of braking assembly 22. Alignment shaft 66 in FIG. 8 has a smaller diameter and slides into cavity 68 of extended alignment spindle 64. Alignment shaft 66 does not occupy the entire length of cavity 68 of extended alignment spindle 64. This is necessary to ensure tip 70 of alignment shaft 66 does not communicate with spindle base plug 28G.

It is to be distinctly understood that where a particular joining or mounting means is illustrated for exemplary purposes, any equivalent such joining or mounting means could be used. Furthermore, typically in a commercial embodiment, one or more elements would be made of a suitable material whereby one or more elements could be made integral with each other without departing from the spirit or scope of the invention.

OPERATION OF THE INVENTION (FIG. 2) Operation begins by partially inserting gripping assembly 20 and braking assembly 22 into inner core C of toilet paper tube B. First, spindles 24G aid 24B are placed in inner core C. Holding caps 32G and 32B are then pressed into inner core C of toilet paper tube B until secure. FIG. 5 best shows how this wedges the tapered outer areas 34G and 34B of holding caps 32G and 32B against the inner surface D of toilet paper tube B which maintains pressure between these parts. Shoulders 36G and 36B of holding caps 32G and 32B set an upper limit to the distance holding caps 32G and 32B may be inserted into toilet paper tube B.

(FIG. 5) Toilet paper roll A is now ready to be mounted into dispenser housing F. First, exterior tip 44B of mounting shaft 40B in braking assembly 22 is placed into recess G of dispenser housing F. Next. exterior tip 44G of mounting shaft 40G of gripping assembly 20 is pressed into spindle 24G. This compresses compression spring 46 located within mounting shaft 40G and spindle cavity 26G. When aligned with recess G and released, compression spring 46 holds mounting shaft 40G into recess G while at the same time maintaining pressure on inner surface D of toilet paper tube B by tapered outer area 34G of holding cap 32G. Spindles 24G and 24B and holding caps 32G and 32B now rotate together with toilet paper roll A.

Stop peg 60 is placed in a hole of peg disc 56, extending towards the flat exterior surface 38 of holding cap 32B. Grounding peas 58 are placed in appropriate holes on peg disc 56 so that stop peg 60 lies in front of and slightly below the axis of rotation of mounting shaft 40B, and so grounding pegs 58 maintain contact with dispenser housing F. (FIGS. 4, 5, 6, and 6A show this at aprox. 25 degrees below the horizontal plane of mounting shaft 40B). This bars rotation of peg disc 56.

This procedure would normally have to be done just once, when the dispenser is first brought home and the pegs installed and adjusted to accommodate tile user's current dispenser housing. When sold together with a dispenser housing, the user would not have to adjust the pegs at all, unless they wanted to adapt its to their own changing habits and needs.

As toilet paper is slowly pulled from roll A, entire toilet paper tube B rotates along with holding caps 32G and 32B and spindles 24G and 24B. As holding cap 32B slowly rotates, FIG. 6 shows the affect of the weak centrifugal force and the stronger gravitational force upon the movement and positions of centrifugal flag 48. Since flag pin 50 holds the end of centrifugal flag 48 rotatably, centrifugal flag 48 pivots about flag pin 50 and reacts to gravitational and centrifugal forces as it rotates on holding cap 32B. As seen in the cross-sectional view in FIG. 7, retaining pin 54 maintains a clearance and does not touch mounting shaft 40B as it sits within groove 52. Therefore, as seen in FIG. 5, mounting shaft 40B allows rotation of holding cap 32B and spindle 24B, but doesn't itself rotate as toilet paper is being unrolled. Interior tip 45 of mounting shaft 40B rounded in order to provide point contact on the axis of mounting shaft 40B for low rotational friction. Peg disc 56, grounding pegs 58, and stop peg 60 are not moving since they are attached to mounting shaft 40B and since grounding pegs 58 are in contact with dispenser housing F.

Once an appropriate amount of toilet paper is selected, the user employs a quick tugging motion with one hand to tear the paper off roll A. The accelerates roll A, causing attached spindles 24G and 24B and holding caps 32G and 32B to accelerate. This speed causes an increase in the centrifugal force on centrifugal flat 48. As centrifugal flag 48 rotates through the angle just prior to stop peg 60, as best seen in FIG. 6A, the centrifugal force outward is sufficient to overcome the gravitational force downward, causing centrifugal flag 48 to be flung outward, contacting stop peg 60. FIG. 5 shows stop peg 60 is on peg disc 56 which can not rotate because grounding pegs 58 are in contact with dispenser housing F. This then stops the rotation of holding caps 32B and 32G and spindles 24B and 24G, as well as the rotation of toilet paper tube B. The paper can now be separated from the roll with one hand and no waste.

The braking mechanism automatically resets itself. When centrifugal flag 48 hits stop peg 60 and toilet paper roll A comes to a complete halt, centrifugal flag 48 recoils from stop peg 60. Gravity then pulls centrifugal flag 48 downward, allowing centrifugal flag 48 to fall inside and clear stop peg 60. Thus the procedure is ready to begin again.

FIG. 8 shows a modification to the preferred embodiment, (as seen in FIG. 5), to provide a more positive and precise alignment of gripping assembly 20 and braking assembly 22. When spindle 24G is inserted into inner core C of toilet paper tube B, extended alignment spindle 64 mates with alignment shaft 66. A space is left between tip 70 of alignment shaft 66 and base plug 28G of spindle 24G to ensure tip 70 doesn't interfere with the action of compression spring 46.

CONCLUSIONS, RAMIFICATIONS, AND SCOPE OF INVENTION

Accordingly, the reader sees the objects of this invention have keen accomplished. This braking mechanism allows the user to employ only one hand to automatically engage the brake while tearing the rolled product from the dispenser.

Furthermore, because of the braking mechanism within this invention, the user receives the amount of product needed with no waste. The user is not left with less product than desired due to premature separation from the roll caused by excessive friction. The user is not left with excess product due to rolls that brake too slowly or spin uncontrollably as the product is torn from the roll.

Another major advantage of this invention is that, unlike other dispensers, it can be adapted to fit the needs and habits of the users. This is done by coordinating the location of the grounding pegs with the position of the stop peg, in relation to the axis of rotation of the mounting shaft. For example, if the grounding pegs are inserted against the housing, thereby locating the stop peg significantly below the horizontal axis of rotation of the mounting shaft, then less rotational steed (and therefore a smaller tug) is necessary to engage the brake. In this position, the gravitational force is less in conflict with the centrifugal force, therefore the brake will engage at a lower speed. This is especially useful for those who are elderly, those who have arthritic hands or those with small children.

In addition, those who prefer to have the rolled product issue from behind and below the roll as opposed to from the top and front of the roll as seen in FIG. 1, would only need to insert the assemblies into opposite ends of the tube before inserting them into the dispenser housing. (In relation to FIG. 1, the braking assembly would then be on the right and the gripping assembly would be on the left and the grounding pegs would be readjusted).

Yet another advantage of this invention is that various embodiments will accommodate rolled product tubes of varying sizes. The extended alignment spindle and the alignment shaft may be used to provide better align of the assemblies when necessary.

Furthermore, this invention provides an additional monetary savings by adapting to most common dispenser housings found in homes today.

Although the description above contains many specificities, these should rot be construed as limiting the scope of the invention but as merely providing illustrations of some of the presently preferred embodiments of this invention. For example, it is obvious that with several centrifugal flags attached to the holding cap, braking would be even faster as there would be less distance before one of the flags hit the stop peg, engaging the brake. The exterior ends of the mounting shafts can be modified to accommodate the various mounting recesses and features of differing dispenser housings on the market today and the grounding pegs may take varying shapes including curved clips, flaps and the like, without wavering from the scope and spirit of this invention. Thus the scope of the invention should be determined by the appended claims and their legal equivalents, rather than by the examples given.

I claim:

1. Apparatus for use in dispensing of axially rolled sheet material, comprising:

a dispenser housing;

a spindle assembly inserted into an axially extending roll of said sheet material for facilitating the rotation thereof, said spindle assembly structured to rotate integrally with said roll;

a holding cap responsive to centrifugal and gravitational forces positioned exteriorly on said spindle assembly for rotation with said spindle assembly;

a mounting shaft rotationally positioned within said spindle assembly;

a stop peg fixedly associated with said mounting shaft and projecting into said holding cap;

said mounting shaft being structured to be non-rotatably supported by said dispenser housing;

a centrifugal flag rotatably mounted on said cap and structured to be responsive to centrifugal and gravitational forces as said cap rotates with said roll such that when said roll is accelerated rotationally faster than a predetermined rate, said flag rotates into engagement with said stop peg to stop the rotation of said spindle assembly and roll.

2. Apparatus as defined in claim 1 further including means on said mounting shaft for controlling the position of said stop peg in relation to said flag.

3. Apparatus as defined in claim 1 further including a groove on said mounting shaft and means coupling said spindle assembly to said shaft.

4. Apparatus as defined in claim 1 wherein said cap is recessed and said stop peg projects into said recess.

5. Apparatus as defined in claim 4 wherein said peg is adjustably mounted on a peg disc which is secured to said mounting shaft.

6. Apparatus as defined in claim 5 wherein said peg disc has a plurality of peg holes, with said stop peg in one of said holes.

7. Apparatus as defined in claim 6 wherein said peg disc includes at least one grounding peg for fixedly securing said disc to said housing, with said grounding peg projecting oppositely from said stop peg.

8. Apparatus as defined in claim 6 wherein said spindle assembly and said cap thereon comprise a braking assembly which is separate from and alignable with a second assembly between which said rolled material is positionable.

9. Apparatus as defined in claim 8 wherein said braking assembly includes said mounting shaft positioned therein and said stop peg on said mounting shaft projects into said spindle assembly for engagement by said flag.

10. Apparatus as defined in claim 8 wherein said braking assembly further includes a shaft extending into a spindle extending from said second assembly.

11. Apparatus as defined in claim 1 wherein said holding cap extends from said mounting shaft uniformly.

12. Apparatus as defined in claim 11 wherein said holding cap terminates in a plug.

13. Apparatus as defined in claim 12 wherein said plug has corners.

14. Apparatus as defined in claim 1 wherein a single holding cap is on said spindle assembly.

15. The method of dispensing a roll of rolled material comprising the steps of:

(a) rotatably mounting a flag on a pivot eccentrically positioned relative to the roll axis such that the flag rotates along with the roll and is responsive to centrifugal and gravitational forces as the roll rotates;

(b) extending said material from said roll that is rotating to cause said eccentrically positioned flag to rotate by centrifugal action into contact with a fixedly mounted stop peg to stop the rotation of the roll to prevent further extension of said material; and (c) tearing the extension of said material from said roll to cause said flag to recoil and be released from said stop peg to prepare said roll for further rotation and controlled dispensing of said material.

16. The method as defined in claim 15 further including the step of adjusting the position of said stop peg in relation to the position of said eccentrically positioned flag.

17. The method as defined in claim 15 further including the step of positioning said stop peg and said flag in a braking assembly which is separate from a gripping assembly by which said roll of material is held for rotation.

18. The method as defined in claim 17 further including the step of enveloping said braking assembly by said gripping assembly.

19. The method as defined in claim 15 further including the step of positioning said flag on a surface towards which said peg projects.

20. The method as defined in claim 15 wherein said roll has opposite ends, further including the step of positioning at one of said ends said eccentrically positioned flag that rotates by centrifugal action into contact with said stop peg; and positioning at the other of said ends means for supporting said roll.

* * * * *